US007144194B2

(12) United States Patent
Kipp, Jr.

(10) Patent No.: US 7,144,194 B2
(45) Date of Patent: Dec. 5, 2006

(54) SURFACE FINISHER

(76) Inventor: John H. Kipp, Jr., 205-F Broadway Ave., Broadway, VA (US) 22815

( * ) Notice: Subject to any disclaimer, the term of this patent is extended or adjusted under 35 U.S.C. 154(b) by 0 days.

(21) Appl. No.: 10/947,180

(22) Filed: Sep. 23, 2004

(65) Prior Publication Data

US 2005/0238429 A1 Oct. 27, 2005

Related U.S. Application Data

(60) Provisional application No. 60/564,219, filed on Apr. 22, 2004.

(51) Int. Cl.
*E01C 19/22* (2006.01)
*E01C 19/24* (2006.01)

(52) U.S. Cl. ..... 404/112; 404/97

(58) Field of Classification Search ..... 404/97, 404/112

See application file for complete search history.

(56) References Cited

U.S. PATENT DOCUMENTS

| | | | | |
|---|---|---|---|---|
| 2,860,506 | A * | 11/1958 | Drummond | 404/112 |
| 4,281,496 | A | 8/1981 | Danielsson | |
| 4,574,532 | A * | 3/1986 | Haberle et al. | 451/451 |
| 4,679,360 | A * | 7/1987 | Eisenblatter | 451/469 |
| 4,735,020 | A * | 4/1988 | Schulz et al. | 451/344 |
| 5,221,156 | A * | 6/1993 | Martin | 404/97 |
| 5,372,452 | A | 12/1994 | Hodgson | |
| 5,468,176 | A | 11/1995 | Udert et al. | |
| 5,678,272 | A * | 10/1997 | McCracken et al. | 15/97.1 |
| 5,911,620 | A | 6/1999 | Spangenberg et al. | |
| 6,021,771 | A | 2/2000 | Swan et al. | |
| 6,058,922 | A | 5/2000 | Sexton | |
| 6,139,217 | A | 10/2000 | Reuter | |
| 6,264,397 | B1 | 7/2001 | Majewski | |
| 6,277,013 | B1 * | 8/2001 | Sasaki et al. | 451/360 |
| 6,299,522 | B1 | 10/2001 | Lee | |
| 6,527,634 | B1 | 3/2003 | Lee et al. | |
| 6,533,650 | B1 | 3/2003 | Yoshida et al. | |
| 6,637,974 | B1 | 10/2003 | Glenn | |
| 2002/0025224 | A1 | 2/2002 | Williamson | |
| 2003/0217743 | A1 | 11/2003 | Gardner | |
| 2006/0083589 | A1 * | 4/2006 | McClain | 404/112 |

FOREIGN PATENT DOCUMENTS

| | | |
|---|---|---|
| EP | 535431 | 4/1993 |

* cited by examiner

*Primary Examiner*—Raymond Addie
(74) *Attorney, Agent, or Firm*—George Walton Parts LLC

(57) ABSTRACT

The surface finisher is an attachment for an angle grinder or other handheld prime mover that precludes the need to finish uncured concrete or other viscous, semi-fluid materials by hand. The surface finisher is a disk having a series of radially disposed blades extending from the plane of the disk, with the blades flexing over the surface to which they are applied to smooth the surface during operation. The disk and blades may be formed as a single, integral component, or may alternatively be formed as a flat, planar disk with a series of removable blades. Either embodiment may be formed of a variety of metal and/or plastic materials. The finishing blades bear against the surface and even out surface irregularities and put a slick, finished surface to the uncured surface, or may be used to form a pattern or texture in the uncured surface by using a contoured blade.

21 Claims, 10 Drawing Sheets

SURFACE FINISHER

CROSS-REFERENCE TO RELATED APPLICATION

This application claims the benefit of U.S. Provisional Patent Application Ser. No. 60/564,219, filed Apr. 22, 2004.

BACKGROUND OF THE INVENTION

1. Field of the Invention

The present invention relates generally to the finishing of various viscous or plastic materials before hardening into a cured state. More particularly, the present apparatus relates to an attachment for an angle grinder or other power source that relieves a user from the necessity of having to finish the surface of concrete, plaster, mortar, drywall compound, and similar viscous substances by hand.

2. Description of the Related Art

Concrete is a mixture of cement, water and aggregates, such as sand or gravel. These components are mixed together and then poured over a surface. For some applications, after concrete has been poured it is desirable to finish the concrete in order to get a smooth, even finish. Finished concrete would be desirable in such places as garage or basement floors or on concrete countertops.

Finishing concrete is a skilled and delicate task. Traditionally, finishing concrete was done with hand trowels. Before newly poured concrete fully sets, typically at the point where finger pressure can just dent the surface of the concrete, hand troweling with a steel hand trowel would begin. To achieve a finished surface on concrete all of the surface pores must be closed. Usually this is accomplished by using a hand trowel. The skilled aspect of finishing concrete lies in the fact that the worker must take care not to disturb the larger areas of aggregate that lie below the surface. If the larger areas of aggregate that lie below the surface are disturbed, the concrete is subject to premature deterioration.

Many different varieties of machines exist to finish concrete and are generally referred to as "troweling machines." A typical troweling machine will have between a 5.5 and 8.0 HP motor, a plurality of fixed pitch blades, and a handle used to maneuver the machine and control the speed of the motor. A disadvantage to troweling machines is their substantial weight. Even when a troweling machine is used to finish a large surface area, such as a garage floor or other enclosed slab, hand trowels must still be used to finish the edges of the floor where a large troweling machine, with its relative lack of maneuverability, cannot reach. For raised or smaller surfaces, such as a concrete countertop or concrete steps, a person must use hand trowels, since a troweling machine would not be practicable. The related art does not provide any tools or methods that would enable a person to finish concrete in small, confined spaces, or in hard to reach edges, without resorting to hand trowels. Moreover, a tool or apparatus capable of providing more versatile use for finishing other plastic materials in addition to concrete, e.g., plaster, drywall compound, mortar, stucco, etc., is highly desirable.

Various devices have been designed for finishing concrete. U.S. Patent Publication No. 2003/0217743, published Nov. 27, 2003, shows a method and apparatus for removing trip hazards in concrete sidewalks. The apparatus is coupled to an angle grinder, but is used to cut a chamfer into a concrete slab, rather than to finish a non-hardened concrete surface. U.S. Pat. No. 5,372,452, issued Dec. 13, 1994 to James A. Hodgson, teaches a power trowel featuring blades made of spring steel. The blades on the power trowel are generally rectangular rather than triangular. The power trowel is also designed for finishing large open floor areas, unlike the present invention, which discloses a tool that can be used with an angle grinder or other prime mover.

U.S. Pat. No. 5,911,620, issued Jun. 15, 1999 to Rolf Spangenberg et al., describes a pot-shaped grinding wheel that is coupled to an angle grinder. The pot-shaped grinding wheel features segment-like grinding surfaces and a different overall shape from the present invention.

Other concrete finishing devices, angle grinder attachments, and related devices are shown in U.S. Patent Publication No. 2002/0025224, published Feb. 28, 2002 (concrete-finishing apparatus), U.S. Pat. No. 4,281,496, issued Aug. 4, 1981 to Jan O. Danielson (method of forming concrete floors and product of the method); U.S. Pat. No. 4,865,227, issued Sep. 12, 1989 to Anthony L. Stephens (dispensing apparatus); U.S. Pat. No. 5,468,176, issued Nov. 21, 1995 to Karl E. Udert et al. (disk-shaped tool bit for an angle grinder); U.S. Pat. No. 6,021,771, issued Feb. 8, 2000 to Leo Swan et al. (surfacing machine with "strip-sert" cutter assemblies); U.S. Pat. No. 6,058,922, issued May 9, 2000 to Marvin P. Sexton (grinding blade for trowel machine); U.S. Pat. No. 6,139,217, issued Oct. 31, 2000 to Bruce W. Reuter (concrete finishing tool); U.S. Pat. No. 6,264,397, issued Jul. 24, 2001 to Charles Majewski (dual trowel. blade assembly); U.S. Pat. No. 6,299,522, issued Oct. 9, 2001 to Chang Hyun Lee (grinding wheel for use in grinding apparatus); U.S. Pat. No. 6,527,634, issued Mar. 4, 2003 to Chang Hyun Lee et al. (grinding wheel with segments for preventing one-sided wear); U.S. Pat. No. 6,533,650, issued Mar. 18, 2003 to Takuma Yoshida et al. (grinding stone); and U.S. Pat. No. 6,637,974, issued Oct. 28, 2003 to J. Brandall Glenn (roller wall guard for floor finishing machines).

European Patent No. 535,431, published Apr. 7, 1993 shows an angle grinder with a disk-shaped abrasive disk.

Finally, the website "hongsui.com/566689" referenced on Mar. 29, 2004 provided a disclosure of a thirty-six inch diameter power trowel powered by a 5.5 horsepower engine and controlled by a handlebar assembly extending therefrom.

None of the above inventions and patents, taken either singly or in combination, is seen to describe the instant invention as claimed. Thus a surface finisher solving the aforementioned problems is desired.

SUMMARY OF THE INVENTION

The surface finisher is an attachment for an angle grinder or other prime mover that relieves a user from the task of finishing semi-fluid concrete and other viscous, plastic materials by hand. The surface finisher comprises a disk having a plurality of blade sections extending or disposed radially from the center of the disk. The disk is adapted for attachment to an angle grinder, power drill, rotary tool, or other prime mover. In one embodiment, the center of the disk has a raised, flat hub with an opening which receives an arbor used to attach the disk to the grinder. The blade sections are offset from the center of the disk by a frusto-conical ramp. Each blade section is defined by radial cuts extending from the ramp to the outer circumference of the disk. Each blade section has three components: a planar stabilizer, an angled intermediate tab sloping downward from the stabilizer, and a finishing blade having an upward, rolled trailing edge.

In another embodiment, the disk and blades may comprise a modular assembly using replaceable blades. A number of blades are removably secured about the peripheral area of a flat, rigid disk, with each of the blades being shaped essentially like the blades of the embodiment described above. While the disk is a relatively thick, rigid component, the relatively thin blades provide sufficient flexibility to glide over the surface of the material being smoothed or finished without digging into the material. A specially configured collar assembly is provided to secure the disk to the rotary shaft of the power tool used to operate the device.

Alternatively, one or more of the blades may include one or more serrations or contours along their trailing edges, in order to sculpt or form circular patterns in the material being worked by the present device.

In a first embodiment surface finisher having four blades, the stabilizers are substantially coplanar and extend through an arc of approximately forty-five degrees. The stabilizers support the angled intermediate tab and the finishing blade. The intermediate tab is bent downwards at an angle of approximately forty-five degrees and extends through an arc of approximately 22.5 degrees in a finisher with four blades. The finishing blade is bent downward from the intermediate tab at an angle of between six and twelve degrees towards the surface being finished and extends through an arc of approximately 22.5 degrees. The finishing blade has a trailing edge that is rounded or slightly bent upwards to prevent scoring the concrete when finishing it. The disk is preferably made from spring steel, but may alternatively be formed of other materials, including plastic to provide a disposable unit. The blades and/or disk of the modular unit may also be formed of various metals or plastics, as desired. The present finishing tool may be provided with more or fewer than four blades, if so desired.

The rotation of the finisher and the downward force exerted by the user will even out an unfinished and uncured concrete or other surface similar to a hand trowel except in a much shorter time and with much less labor on the part of the user. Hand troweling is a long process where the unfinished concrete surface must be evened and smoothed repeatedly for a considerable time. A user will know how much downward pressure to apply to the finisher based on the set time of the concrete and the particular type of concrete being used. The finisher may be constructed of spring steel so that the finisher returns to its original shape when no pressure is applied. The finisher may also be constructed out of magnesium or other metals so that the finisher can also be used to float the concrete. "Floating" concrete refers to drawing a float made of aluminum, magnesium, wood, cork, or rubber over the surface of the concrete in order to draw entrained air or water to the surface. Floating is the last step before hand troweling. By making the finisher out of magnesium the steps of floating and finishing can be combined to save time and labor.

The compact design of the finisher makes it ideal for such applications as the edges of enclosed slabs, concrete steps, and concrete countertops. The device also lends itself to use in finishing other viscous, somewhat plastic or semi-fluid materials before they harden or cure, e.g., drywall compound, stucco, plaster, mortar and grout, etc. Because of the inexpensive design and the fact that the finisher may be used with a variety of prime movers, the finisher is suited for both commercial and residential use.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
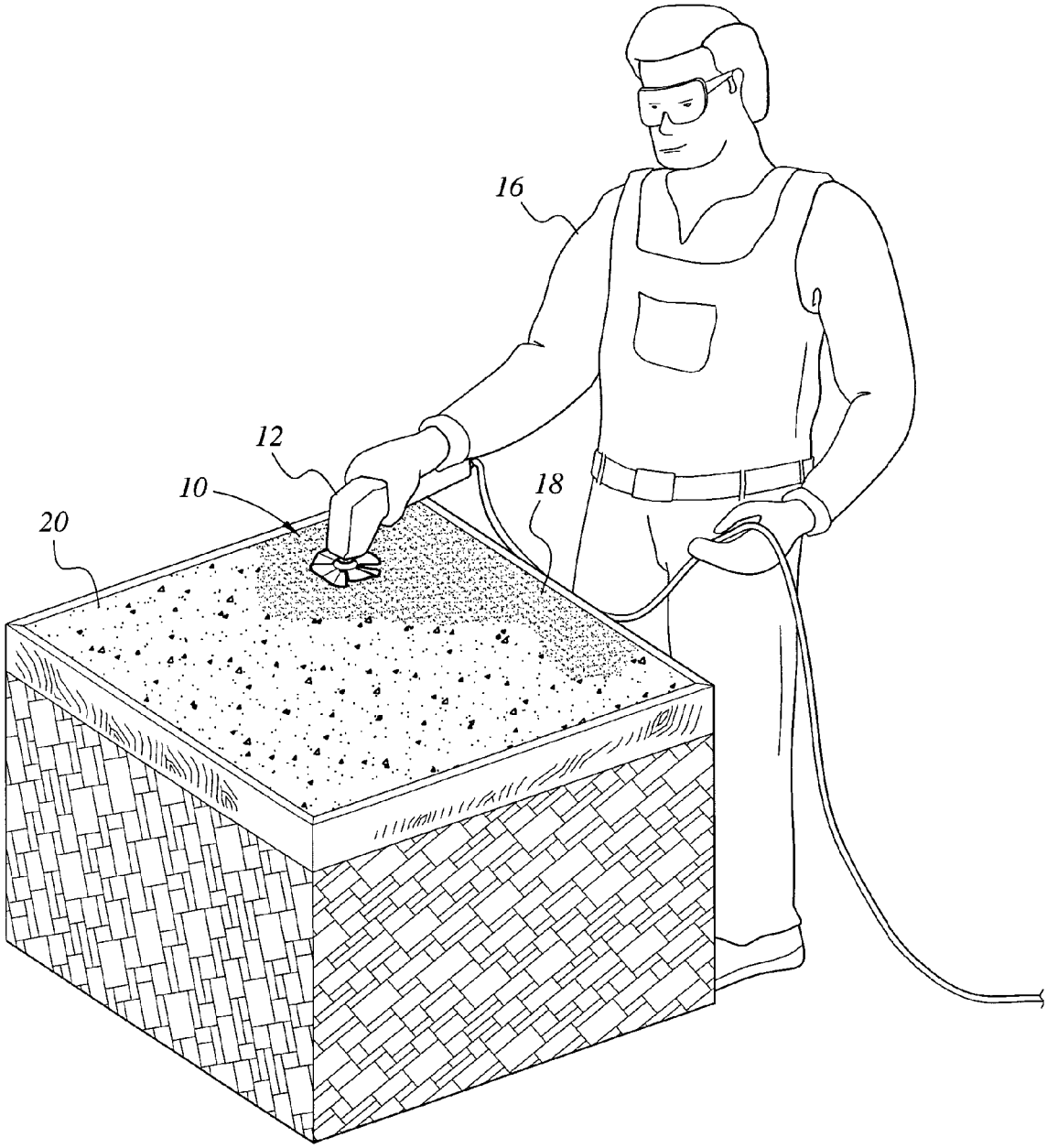
FIG. 1 is an environmental, perspective view of a surface finisher according to the present invention, showing the operation of the device in finishing a concrete countertop.
Figure 2:
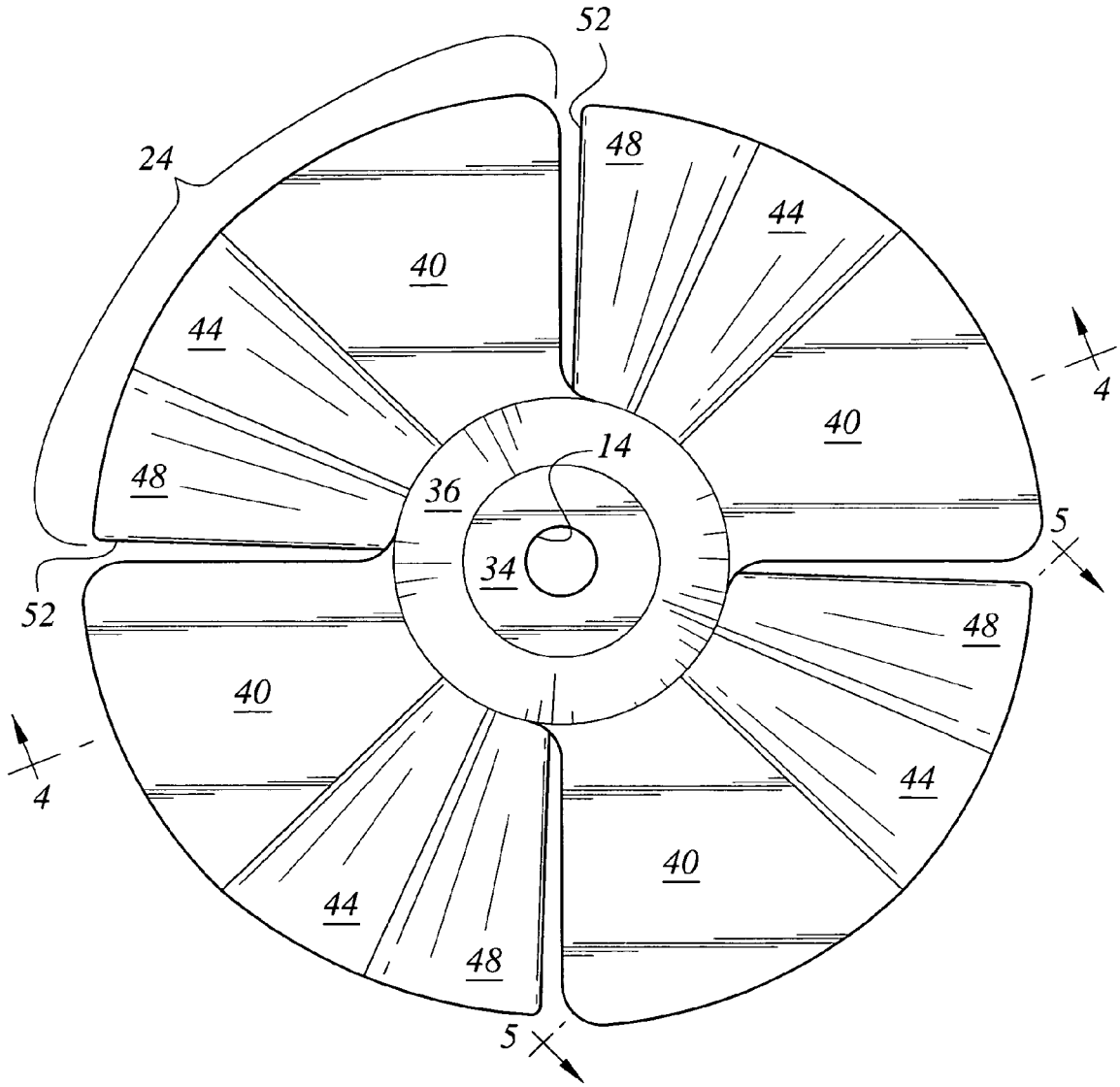
FIG. 2 is a top plan view of a first embodiment surface finisher according to the present invention.
Figure 3:
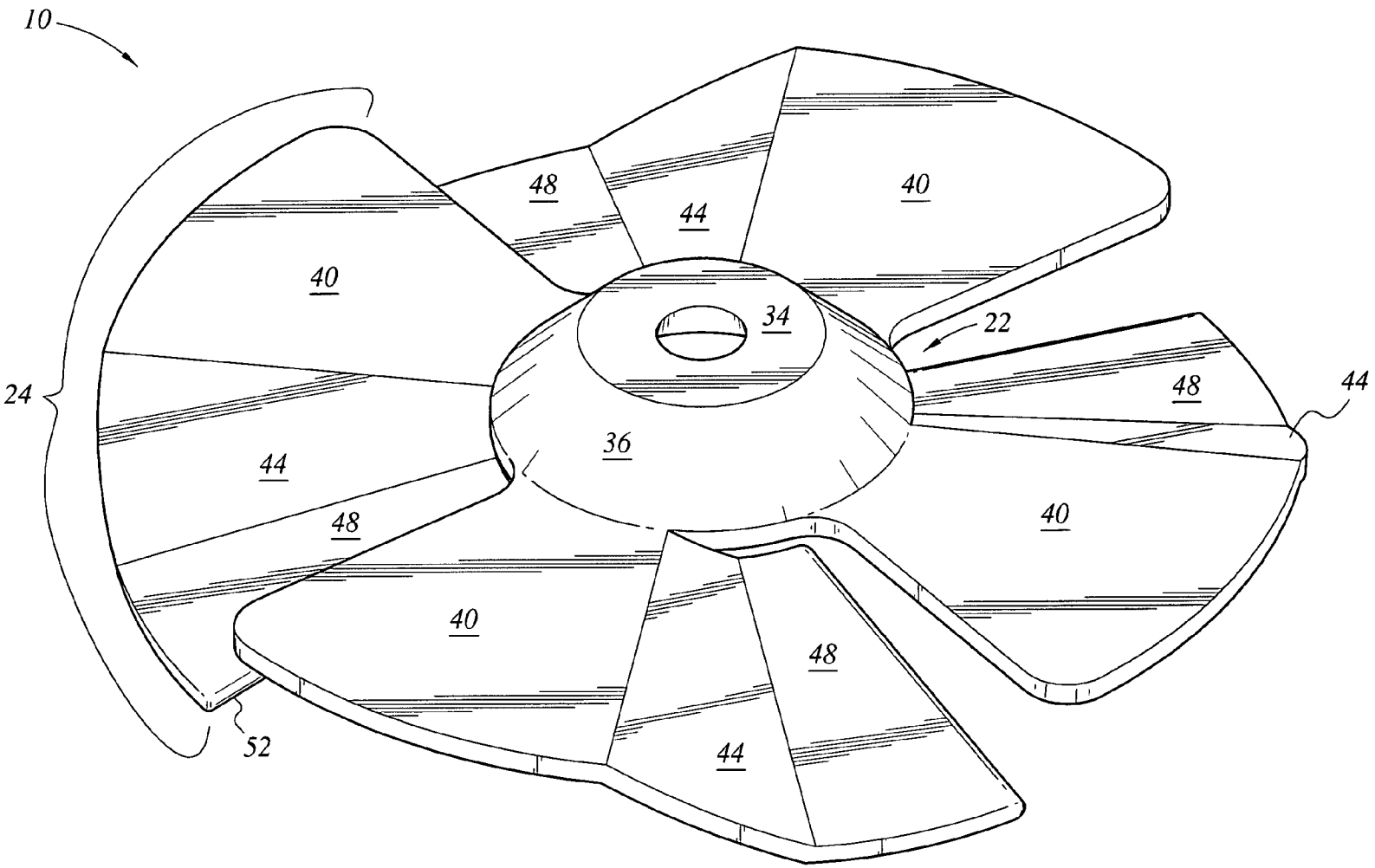
FIG. 3 is a perspective view of the surface finisher of FIG. 2.
Figure 4:
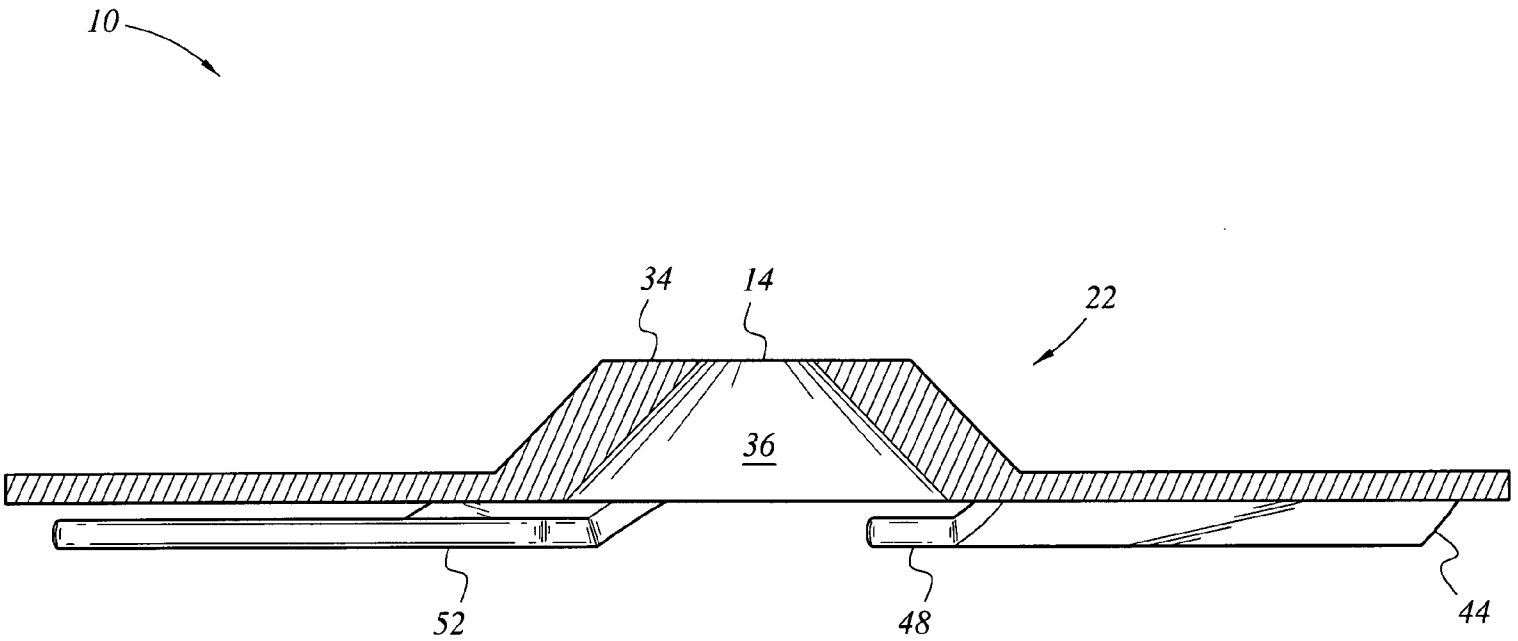
FIG. 4 is a section view along lines 4—4 of FIG. 2.
Figure 5:
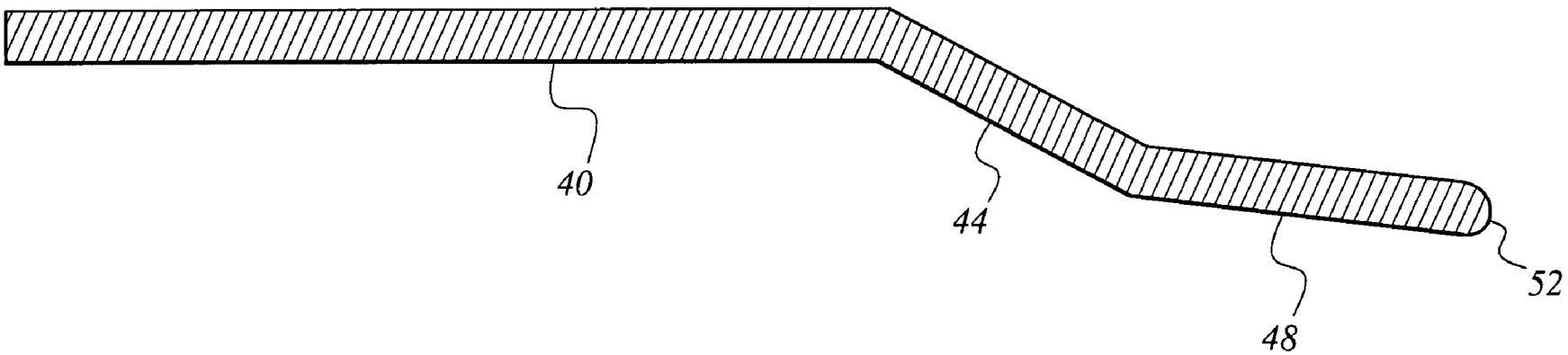
FIG. 5 is a section view along lines 5—5 of FIG. 2.

The present invention is a surface finisher, a first embodiment of the finisher being designated generally as 10 in the drawings. As shown in FIG. 1, the surface finisher 10 is coupled to an angle grinder 12 or other hand-operated power tool, such as a drill, rotary tool, etc. The angle grinder 12 may have variable speed control. Variable speed control allows the user to slow down or speed up the surface finisher 10, dependent on what stage of the setting process the concrete or other viscous, semi-fluid material is in. The portable nature of angle grinder 12 further allows the user 16 to put the correct amount of pressure on the surface finisher 10 to achieve the desired surface smoothness from the surface finisher 10, and further to use the surface finisher 10 in confined or awkward areas. FIG. 1 shows a user 16 in the act of finishing the surface 18 of a concrete countertop 20. The surface finisher 10 may be configured to work along the edges of relatively small areas, and accordingly may be constructed to have a relatively small diameter. However, the diameter of the device 10 is physically limited only by the power output of the power tool with which it is used.

FIGS. 2, 3, 4 and 5 show the surface finisher 10 in more detail. The surface finisher 10 shown in the drawings is designed to rotate in a right-hand or clockwise direction. The finisher 10 is a disk having a central portion 22. The central portion 22 is in the shape of a truncated cone with a flat, circular center hub 34 having an opening 14 in the center of the hub 34 to accommodate a spindle, arbor, or other shaft used to attach the finisher 10 to an angle grinder 12 or other prime mover. The central portion 22 includes a frusto-conical ramp 36 extending downward at approximately a forty-five degree angle from the hub 34 in order to offset the blade sections 24 from the mounting plate 34, thereby creating a recess to accommodate a lock nut used for mounting the finisher 10 to the spindle of the angle grinder 12.

The surface finisher 10 shown in the drawings has four blade sections 24, but alternatively the surface finisher 10 may have a lesser or greater number of blade sections 24.

The blade sections 24 are divided from each other by making an L-shaped cut along the radius of the surface finisher 10 from the outer periphery of the surface finisher 10 to the lower circumference of the central portion 22 and along the lower circumference of ramp 36 through forty-five degrees of arc. At the end of the L-shaped cut a stop drill hole (not shown) may be added to decrease metal fatigue to the blade section 24. The portion of the blade section 24 attached to ramp 36 is a flat, planar stabilizer 40. Blade section 24 is crimped radially in two places. The first crimp is at the end of the end of the L-shaped cut, where the blade section 24 is bent downward from the stabilizer 40 at a forty-five degree angle to form an intermediate angle tab 44. The second crimp, which is also on a radius of the surface finisher 10, is bent downward at an angle of between six and twelve degrees relative to the plane of the stabilizer 40 and is referred to as the finishing blade 48. The trailing edge 52 of the finishing blade is rounded or bent slightly upwards in order prevent scoring the concrete or other material being worked.

In a finisher 10 having four blade sections 24, each stabilizer extends through an arc of about 45°, and all of the stabilizers 40 are coplanar with each other. Each intermediate tab 44 extends through an arc of about 22.5°, and each finishing blade 48 extends through an arc of about 22.5°.

Where the present surface finisher is used to finish the surface of uncured concrete, the user will know the proper set time of the concrete and at what point to begin finishing the concrete based on the particular properties of the concrete. There are many varieties of concrete based on geographic area and application. A general rule is that the finishing process begins when a person can just dent the surface of unset concrete with their finger. The user applies the rotating surface finisher 10 to the concrete surface with sufficient pressure to continually smooth the surface. The finishing blade 48 is the only part of the surface finisher 10 in contact with the concrete surface. Because the finishing blade 48 is at an angle as the finisher rotates, irregularities in the unfinished concrete are smoothed over, leaving the concrete with an even surface. The last part of the surface finisher 10 to contact the concrete is the trailing edge 52 of the finishing blade 48, which leaves the concrete with a slick, smooth, finished appearance.

In the embodiment of FIGS. 1 through 5 the surface finisher is of one-piece construction and made of spring steel. Alternatively the finisher may be made of magnesium or other metals so that the finisher may also be used to float concrete as well as finish it.

FIGS. 6 through 9B provide illustrations of additional embodiments of the present surface finishing device, primarily directed to embodiments having a flat, planar disk with removably attached, replaceable blades. However, many of the features of the embodiments of FIGS. 6 through 9B, e.g., varying numbers of blades, blades having non-planar edges or surfaces for forming textures in materials during the finishing process, etc., may be incorporated with the surface finisher of FIGS. 1 through 5 as well. An attachment collar assembly for securing the disk or plate to the output shaft of a rotary power tool (angle grinder, etc.) is also disclosed.

Figure 6:
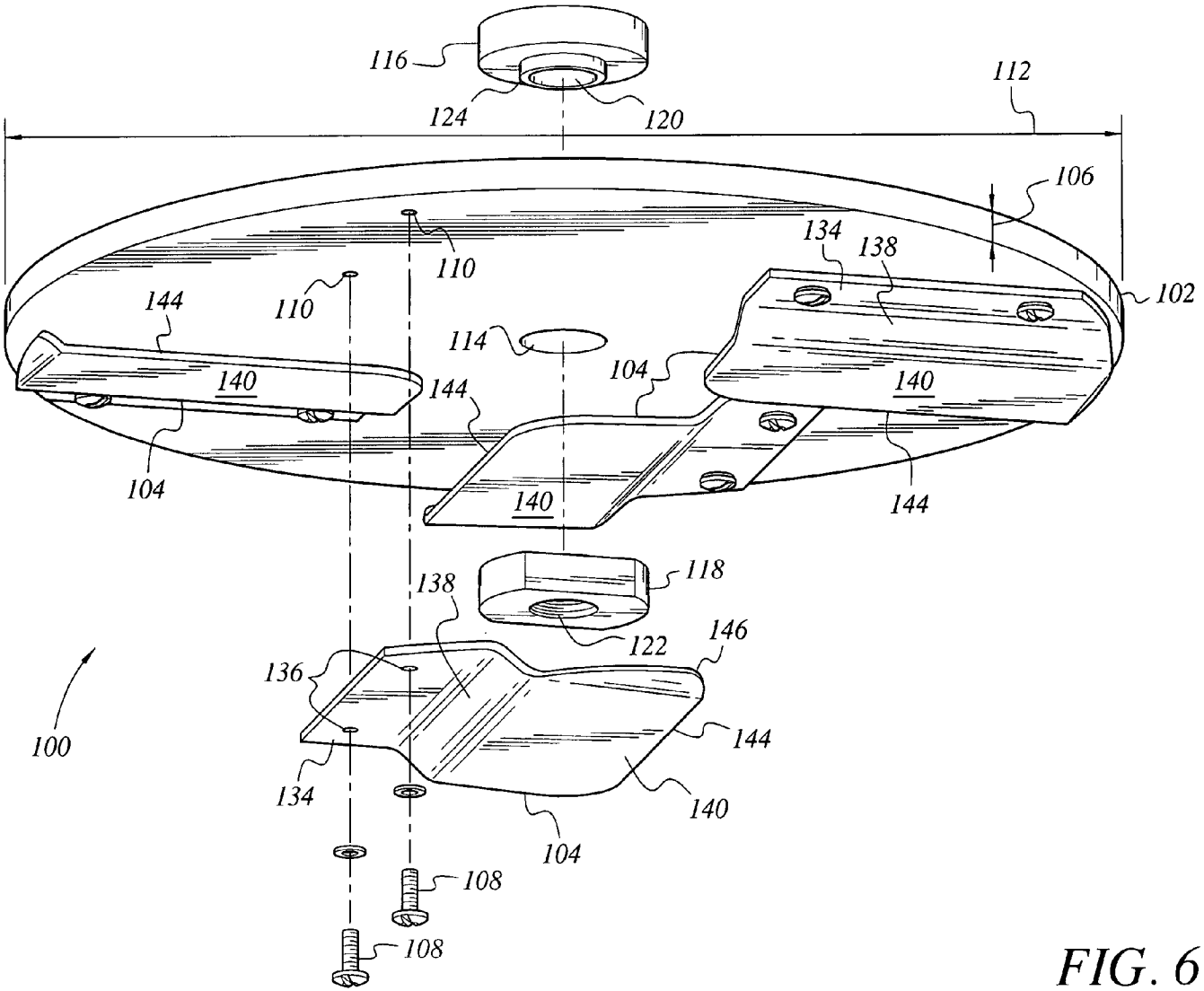
FIG. 6 is an exploded perspective view of a second embodiment of the present surface finisher having replaceable blades.

In FIG. 6, a surface finisher assembly 100 is shown, with the finisher 100 having a flat, planar disk or plate 102 and a series of replaceable blades 104 therewith. The disk or plate 102 may be formed of a variety of rigid or flexible materials, e.g., steel, aluminum, plastic, etc., as desired, with less costly materials providing for an economically disposable disk, if so desired. The disk 102 may have a thickness 106 sufficient to provide limited flexibility at most, rather than being flaccid, with the thickness 106 also providing for the attachment of the blades 104 to the disk 102 using conventional threaded fasteners 108 or the like which thread into mating blade attachment passages 110 in the disk 102. Other means of removably securing the blades 104 to the disk 102 may be provided as desired, e.g., clips, mating hook and loop fastening material (e.g., Velcro®), etc. The diameter 112 of the disk 102 may be formed to be compatible with the power tool used to drive the device, with disks 102 used with relatively smaller handheld power tools having suitable diameters for use therewith. A disk 102 diameter of about eight or nine inches or so is reasonable for use with such tools to avoid overloading a handheld power tool and to facilitate working in corners and other areas of limited space, but larger or smaller diameter disks may be formed as desired.

Figure 7:
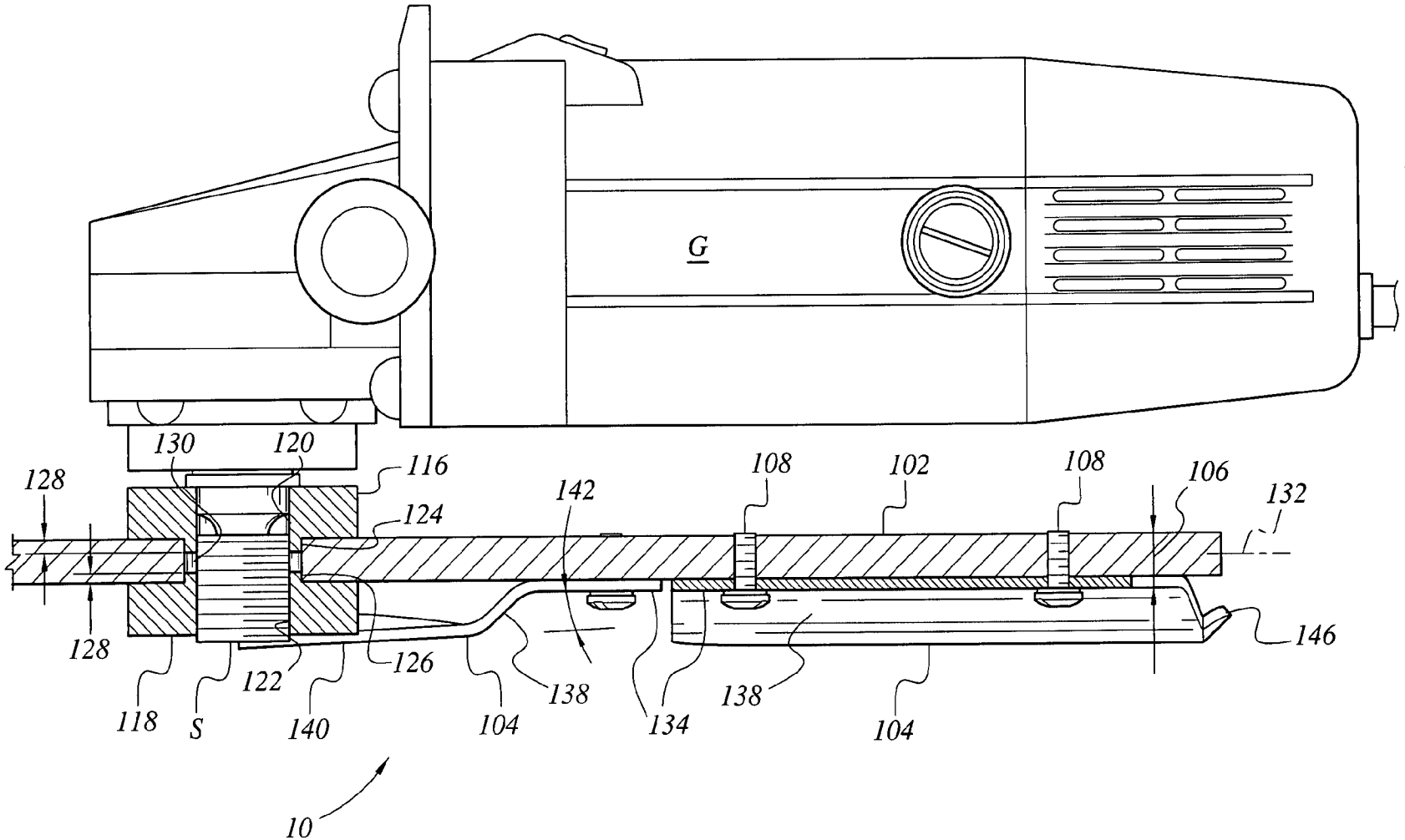
FIG. 7 is a side elevation view in partial section of the second embodiment finisher assembly, showing its installation upon a surface grinder.

The disk or plate 102 includes a concentric power tool shaft attachment passage 114 therethrough, configured to fit closely about the output shaft of the power tool with which the finisher assembly 100 is used. A tool attachment collar assembly comprising a tool spacer 116 and threaded attachment nut 118 is used to secure the disk 102 to the rotary output shaft of the power tool. FIG. 6 provides an exploded perspective view of this tool attachment collar assembly, with FIG. 7 showing the completed assembly in section. The tool spacer 116 has an unthreaded tool shaft passage 120 therethrough, with an inner shoulder which rests against a circumferential flange on the tool output shaft S. The opposite attachment nut 118 includes a threaded tool shaft installation passage 122 therethrough, which threads onto the threaded portion of the tool output shaft S FIG. 7. The disk or plate 102 is sandwiched between the two collar components 116 and 118 for secure attachment to the power tool output shaft S.

It can be difficult to position the disk 102 accurately on the output shaft S, to preclude wobbling or other non-true rotation of the disk 102 during operation. The disk attachment collar assembly solves this problem by means of a concentric annular spacer flange 124 and annular attachment nut flange 126, formed about the respective tool shaft passages 120 and 122 of the two components 116 and 118. These two flanges 124 and 126 fit 102 closely within the tool attachment shaft passage 114 of the disk, to center the disk 102 precisely on the power tool output shaft S.

The two flanges 124 and 126 also assist in clamping the disk 102 securely between the two collar components 116 and 118. Each flange 124 and 126 has a height 128, with the two flange heights 128 having an additive total which is somewhat less than the thickness 106 of the disk 102. The resulting gap 130 between the two flanges 124 and 126 provides room for the collar components 116 and 118 to grip the center of the disk 102 securely therebetween, precluding any motion outside of the rotary plane 132 of the disk 102.

Other disk attachment means may be provided, depending upon the specific configuration of the power tool (e.g., angle grinder G, as shown in FIG. 7, etc.) with which the present surface finisher is used. If sufficient thread depth is provided on the output shaft, or sufficient spacers are used, the shaft attachment passage of the disk may be threaded to thread onto the power tool output shaft, with a second threaded nut secured to the shaft over the disk to serve as a jam nut and lock the assembly in place. This system is used in the attachment of various threaded devices, and may be adapted to the present tool assembly as well.

The surface finishing blades 104 of the present surface finisher assembly 100 are removably attached to the disk 102, as noted further above. Each blade 104 is formed of a thin, flexible sheet of material, e.g., various metals or plastic, etc. While metal blades provide greater durability and longevity, plastic blades may provide for more economical replacement. Moreover, the blades may be specially shaped or configured to provide certain specialized textures in the material being worked, and a worker may wish to have several sets of differently contoured blades at hand to form different patterns or textures in a surface. Plastic blades may economically accomplish this need for numerous differently contoured blades.

Each of the blades 104 has a flat disk attachment portion 134 with one or more attachment passages 136 therethrough, or other disk attachment means. An intermediate portion 138 extends from the disk attachment portion 134, away from the rotary plane 132 of the disk 102. A surface contact portion 140 extends from the intermediate portion 138, with the intermediate portion 138 angularly disposed between the disk attachment portion 134 and the surface contact portion 140. The intermediate portion 138 of each blade 104 is angled away from its disk attachment portion 134 by about forty-five degrees (more or less), with the surface contact portion 140 forming a slightly shallower angle with the intermediate portion 138. This results in an angle 142 between the offset surface contact portion 140 of each blade 104 and the disk attachment portion 134 thereof (and therefore the rotary plane 132 of the disk 102), of between four and twelve degrees (more or less) when the blades 104 are installed upon the disk 102, as shown in FIG. 7. Other angles may be formed as desired, but the shallow angle of the surface contact portion 140 of the blades 104 with the underlying surface being worked (so long as the plane 132 of the disk 102 is parallel to the underlying surface) results in the trailing edge 144 of each blade 104 planing over the underlying surface to provide a smoothing and polishing action thereon.

The outer peripheries 146 of the blades 104 may be provided with convex curvature closely matching the radius of curvature of the disk 102 with which they are used. Careful positioning of the attachment passages 110 in the disk 102 and passages 136 of the disk attachment portions 134 of the blades 104, or other attachment means, results in the outer edges 146 of the blades 104 defining a rotational diameter substantially equal to the diameter 112 of the disk 102 when the blades 104 are secured to the disk 102. This results in minimal loss of coverage by the blades 102 of the assembly 100. However, the outer edges 146 of the blades 104 may be turned or bent toward their respective disk attachment portions 134, as shown in FIGS. 6 and 7. This precludes the outer edges 146 "digging in" to the underlying surface being worked during operation of the surface finisher device 100 or other embodiments thereof.

Figure 8A:
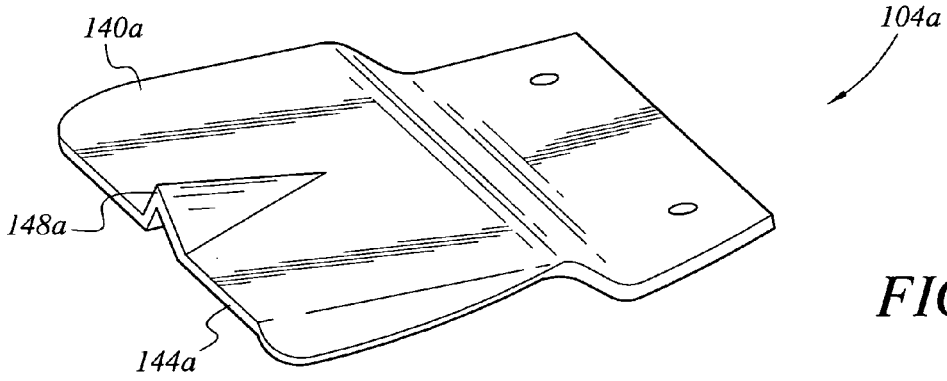
FIGS. 8A, 8B and 8C are perspective views of a series of different serrated or contoured blades for forming patterns in the material being worked.
Figure 8B:
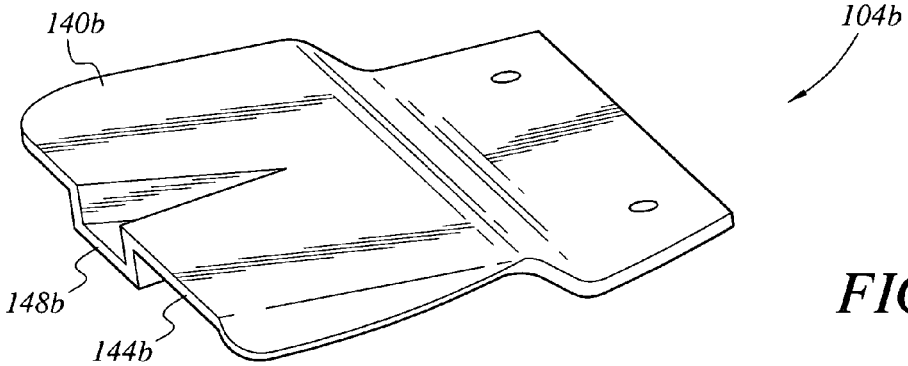
Figure 8C:
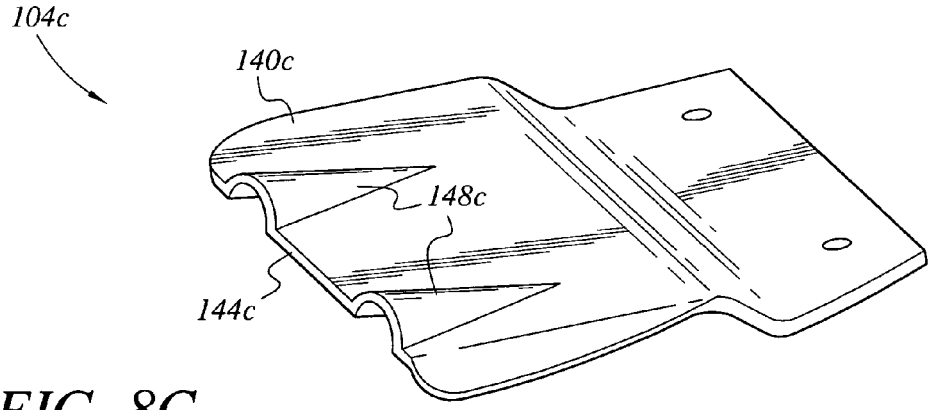

In many instances, a rougher or more textured finish may be desired. This may be accomplished with the present tool by shaping or otherwise forming the trailing edge(s) and/or surface contact portion(s) of at least one of the blades of a set of blades installed on a disk. FIGS. 8A through 8C provide illustrations of various reshaped blades, designated blades 104*a* through 104*c* respectively, which may be formed to carry out such texturing of the surface being worked. The blade 104*a* of FIG. 8A includes an outwardly (i.e., away from the disk when the blade 104*a* is installed thereon) bent or formed surface pattern forming contour 148*a* having a generally triangular cross section, formed in the surface contact portion 140*a* and trailing edge 144*a* of the blade 104*a*. The blade 104*b* of FIG. 8B includes an inwardly formed surface pattern forming contour 148*a* formed in its surface contact portion 140*b* and trailing edge 144*b*, with the contour 148*a* having a generally rectangular or square cross section. In the example of FIG. 8C, the blade 104*c* includes a pair of outwardly formed, semicircular cross section surface pattern forming contours 148*c* extending from the surface contact portion 140*c* and trailing edge 144*c* thereof. The remainder of the blades 104*a* through 104*c* are essentially identical with the blades 104 of FIGS. 6 and 7.

Innumerable other contours, e.g. one or more saw or rake teeth, scallops, different geometrical cross sectional shapes, etc., either evenly or unevenly spaced, may be provided on one or more blades as desired. It will be seen that such surface forming texture blades 140*a* through 140*c* , and blades having other contours, may be provided in either the replaceable blade format of FIGS. 8A through 8C or as blades forming permanent, integral components of a disk such as the disk 10 of FIGS. 1 through 4, as desired. The installation of even a single blade having one or more such surface forming contours to a surface finishing disk of the present finisher assembly, will result in a pattern of circular or semicircular swirls being formed in the material being worked, which can provide a pleasing textured appearance when set.

Figure 9A:
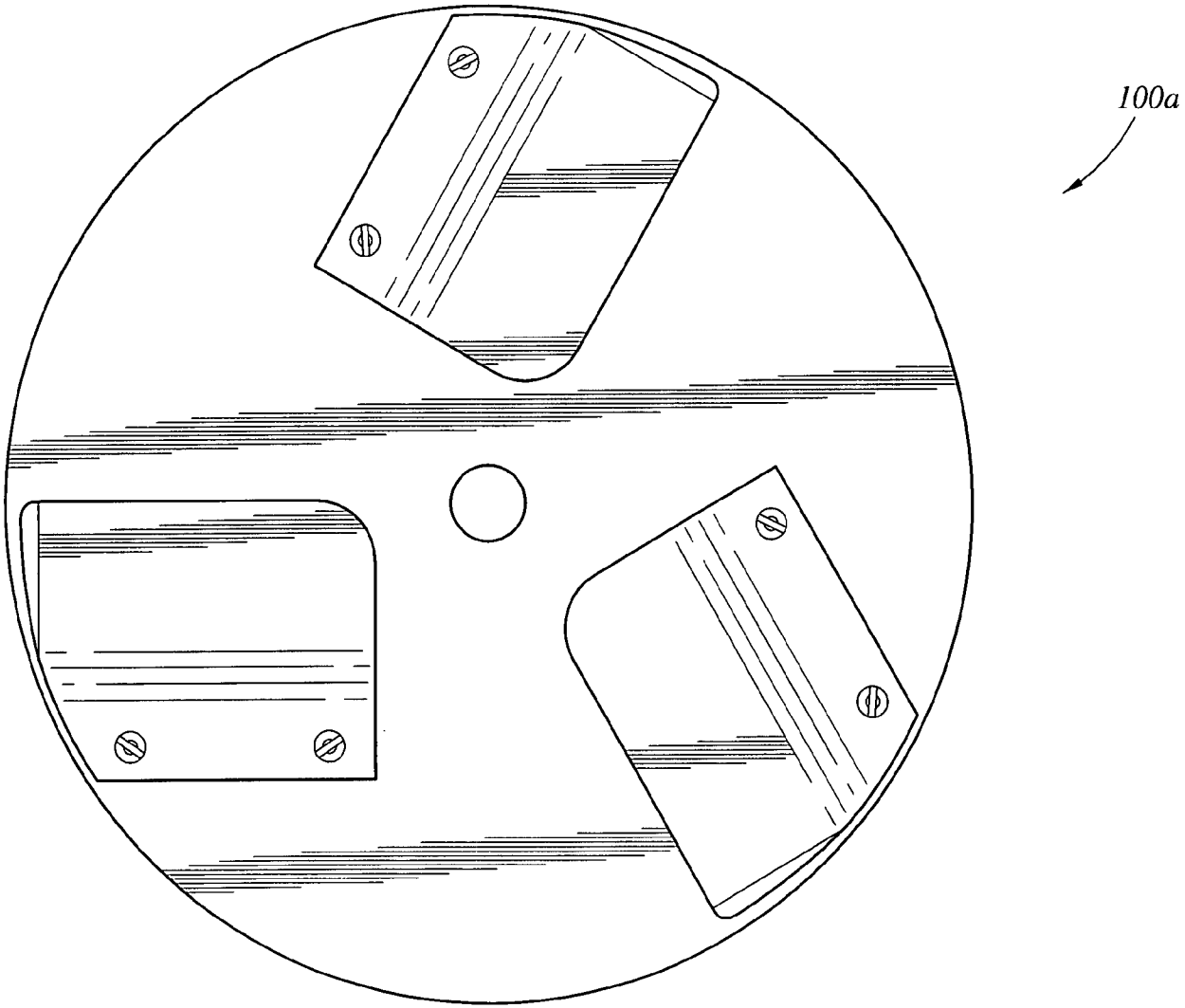
FIGS. 9A and 9B are bottom plan views of three blade and five blade modular finishing disk and blade assemblies, respectively.
Figure 9B:
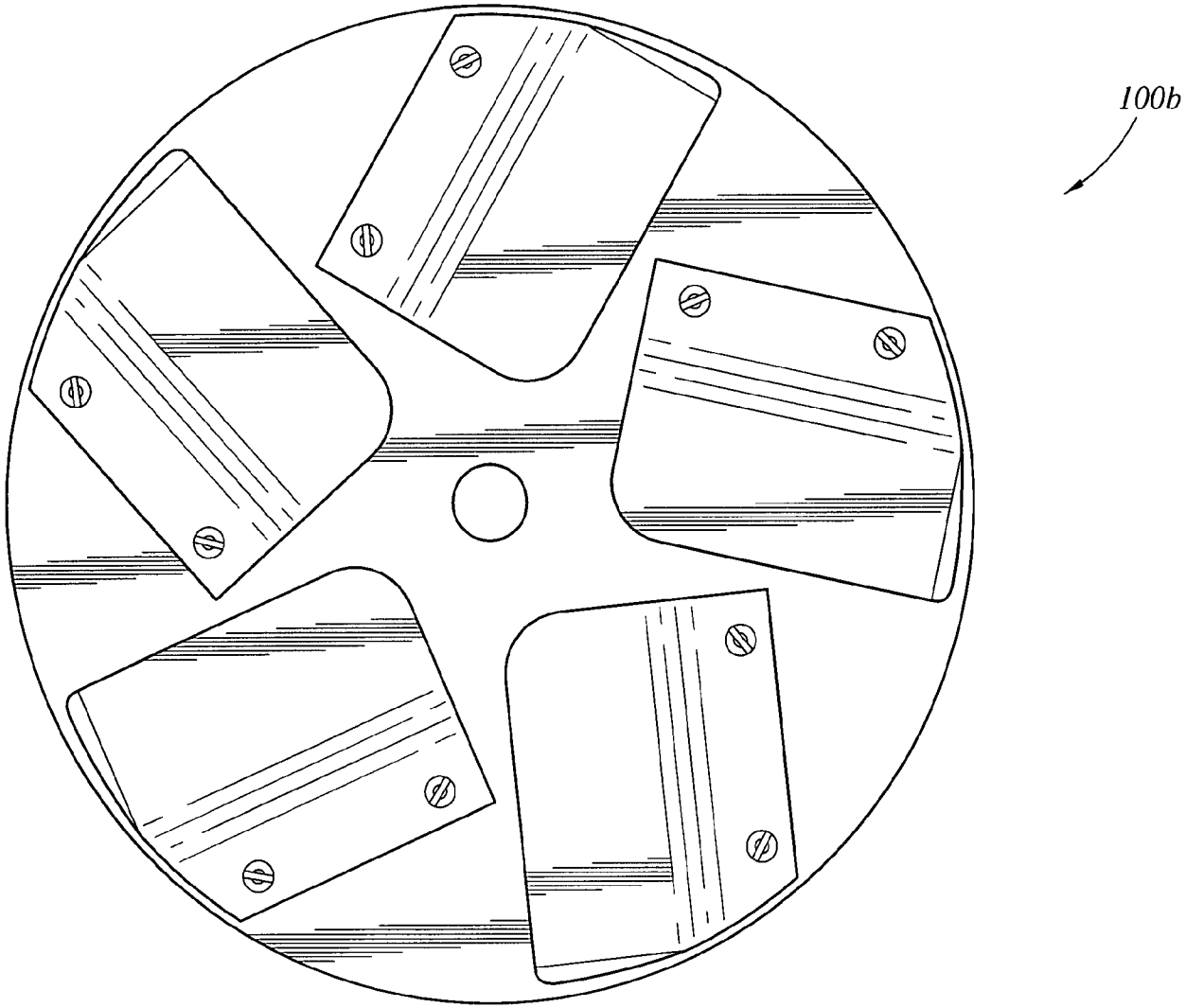

To this point, the various embodiments disclosed have each had four blades. This is not an absolute requirement, however, and a greater or smaller number of blades may be provided as desired. FIGS. 9A and 9B provide plan views respectively of a three blade disk assembly 100*a* and a five blade disk assembly 100*b* . While these assemblies are of the removable disk configuration, it will be seen that the integral disk and blade construction of FIGS. 1 through 4 may be adapted to have more or fewer blades than the four blades shown.

In conclusion, the present surface finisher in its various embodiments greatly facilitates the finishing of concrete, stucco, drywall compound, plaster, mortar, grout, and other viscous materials which harden and cure after working. Heretofore, it was necessary for a craftsman to laboriously finish such materials by hand, particularly in relatively close or confined areas such as concrete countertops, steps, and the like where it is impractical or impossible to operate a large, motor driven trowel. The present device can also be used for "floating" concrete, depending upon the rpm used and the stage of cure for the concrete being worked. The present tool is a most economical means of carrying out such work, when used with an existing rotary power tool which most craftsmen possess. The provision of serrated or otherwise non-smooth blade surfaces or trailing edges, enables the craftsman to form textured surfaces in the material being worked, if so desired. This can not only serve to provide a pleasing appearance, but may also be used to finish concrete step treads and the like to provide a non-skid surface thereon. Thus, the present surface finisher will find a wide range of uses and will prove to be a most valuable tool to those engaged in such finishing work.

It is to be understood that the present invention is not limited to the embodiments described above, but encompasses any and all embodiments within the scope of the following claims.

I claim:

1. A surface finisher being attached to a power tool, comprising a disk having:

a frusto-conical central portion adapted for attachment to a rotatable shaft of a prime mover of the power tool; and a plurality of spaced apart blade sections extending radially outward from the central portion, each of the blade sections having:

a planar stabilizer, the stabilizers being coplanar, with a portion thereof secured to the central portion of the disk;

an intermediate tab angled away from the stabilizer at various angles that can be selected to be at least at approximately a forty-five degree angle and spaced from and out of contact with the central portion; and, wherein said blade sections further comprise a finishing blade angled away from the intermediate tab at various selective angles relative to the plane in which the stabilizers are disposed, while being spaced from and out of contact with the central portion, wherein the finishing blade defines at least one edge portion that is bent at an angle toward said disk to prevent scoring of the material being worked.

2. The surface finisher according to claim 1, wherein said disk and blade sections are a one-piece continuous member made from any one of the group comprising metals and plastics.

3. The surface finisher according to claim 1, wherein each said finishing blade has an outer edge having a bend toward said stabilizer.

4. The surface finisher according to claim 1, further including a handheld angle grinder power tool.

5. The surface finisher according to claim 1, wherein the finishing blade of at least one of said blade sections further includes any one of a plurality of surface pattern forming contours formed on a surface contact face.

6. A surface finisher being attached to a rotary shaft of a power tool, the surface finisher comprising:

a flat, rigid, planar tool attachment disk defining a rotary plane and having a diameter, a thickness, a central tool attachment shaft passage therethrough for receiving the power tool rotary shaft, and a plurality of blade attachment passages therein; and a plurality of spaced apart thin, flexible surface finishing blade components being attached to said disk and spaced from and out of contact with the central tool attachment passage, and within and contiguous to the circumference of said disk, each of said blade components having a disk attachment portion that is secured to the blade attachment passages, a surface contact portion displaced from the disk attachment portion, an intermediate portion between the disk attachment portion and the surface contact portion, and said surface contact portion including a finishing blade element angled away at selective angles from the intermediate portion with at least one edge portion thereon that is bent at an angle toward said disk to prevent scoring of the material being worked.

7. The surface finisher according to claim 6, further including a handheld angle grinder power tool.

8. The surface finisher of claim 6, further comprising a tool attachment collar assembly.

9. The surface finisher according to claim 8, wherein said collar assembly comprises:

a tool spacer having an unthreaded tool shaft passage therethrough and a concentric annular spacer flange fitting closely within the tool attachment shaft passage of said disk when installed therewith; and an attachment nut having a threaded tool shaft installation passage therethrough and a concentric, annular nut flange fitting closely within the tool attachment shaft passage of said disk when installed therewith; and the shaft flange and the nut flange having an additive total height less than the thickness of said disk, thereby clamping said disk securely between said tool spacer and said attachment nut when secured upon the rotary shaft of the power tool.

10. The surface finisher according to claim 6, wherein each of said finishing blade components are removably secured to said attachment disk, and said finishing blade element has an outer edge having a bend toward said disk attachment portion thereof.

11. The surface finisher according to claim 6, wherein: the intermediate portion of each of said blade components has an angle of about forty-five degrees to the disk attachment portion thereof; and the surface contact portion of each of said blade element has an angle of various selective degrees, wherein a preferred angle of the surface contact portion can be selected to be at least between four and twelve degrees from the surface attachment portion thereof, if desired.

12. The surface finisher according to claim 6, wherein the finishing blade components are made from any one of the group comprising metals and plastics, and at least one finishing blade element further includes at least one surface pattern forming contour on a face of said surface contact portion, wherein the at least one surface pattern forming contour can be any one of a variety of shapes and sizes.

13. A power tool with a surface finisher, comprising in combination:

a tool attachment disk having a plurality of spaced apart thin, flexible surface finishing blade components extending from said disk at different spaced locations thereon, with each of said blade components having at least a first surface secured at the different locations, a second surface having an intermediate portion that extends at an angle from the first surface and a third surface defining a finishing blade portion having a surface contact portion extending angularly away from the second surface and displaced from the plane of said disk at selective angles with at least one edge portion thereon that is bent at an angle toward said disk to prevent scoring of the material being worked;

a handheld power tool; and a tool attachment collar assembly removably attaching the disk to a rotatable shaft of a prime mover of the power tool through a central tool attachment passage, wherein the finishing blade components being spaced and extending outwardly from the central tool attachment passage, and within and contiguous to the circumference of said disk.

14. The power tool with a surface finisher according to claim 13, wherein:

said disk further includes a frusto-conical central portion adapted for attachment to the rotatable shaft of the prime mover of the power tool;

said first surface defines a planar stabilizer, the stabilizers being secured to the central portion of said disk;

said second surface intermediate portion defines an intermediate tab angled away from the stabilizer at an angle defined by various selective degrees; and said finishing blade portion being angled away from the intermediate tab at least at an angle defined by various degrees, wherein the angle of the finishing blade portion can be selected to be at least between six and twelve degrees relative to the plane in which the stabilizers are disposed, if desired.

15. The power tool with a surface finisher according to claim 13, wherein: said tool attachment disk comprises a flat, rigid component defining a rotary plane and having a diameter, a thickness, a central tool attachment shaft passage therethrough, and a plurality of blade attachment passages therein; and said finishing blade components are removably attached to said disk, each of said blade components having a disk attachment portion that is removably attached via said blade attachment passages, the surface contact portion being displaced from the disk attachment portion, and the intermediate portion being positioned between the disk attachment portion and surface contact portion.

16. The power tool with a surface finisher according to claim 13, wherein said power tool is an angle grinder.

17. The power tool with a surface finisher according to claim 13, wherein said collar assembly comprises:

a tool spacer having an unthreaded tool shaft passage therethrough and a concentric annular spacer flange fitting closely within the tool attachment shaft passage of said disk when installed therewith; and an attachment nut having a threaded tool shaft installation passage therethrough and a concentric annular nut flange fitting closely within the tool attachment shaft passage of said disk when installed therewith;

the shaft flange and the nut flange having an additive total height less than the thickness of said disk, thereby clamping said disk securely between said tool spacer and said attachment nut when secured upon the rotary shaft of the power tool.

18. The power tool with a surface finisher according to claim 13, wherein each of said finishing blade portion has an outer edge having a bend toward said disk attachment portion thereof.

19. The power tool with a surface finisher according to claim 13, wherein:

the intermediate portion of each of said finishing blade components has an angle of about forty-five degrees to the disk attachment portion thereof; and the surface contact portion of each of said finishing blade portion has an angle of various selective degrees, wherein the angle of the surface contact portion can be selected to be at least between four and twelve degrees from the disk attachment portion thereof.

20. The power tool with a surface finisher according to claim 13, wherein the finishing blade components are made from any one of the group comprising metals and plastics, and at least one of said finishing blade portions has at least one surface pattern forming contour formed on a face of said surface contact portion, wherein the at least one surface pattern forming contour can be any one of a variety of shapes and sizes.

21. A surface finisher having a tool attachment collar assembly for removably securing a surface finishing disk to a rotary power tool shaft, the disk having a thickness and a tool attachment shaft passage therethrough and a plurality of blade attachment passages therein; the disk having:

a plurality of spaced apart thin, flexible surface finishing blade components being attached to said disk spaced outwardly from the tool attachment passage and within and contiguous to the circumference of said disk, each of said blade components having a disk attachment portion that is secured to the blade attachment passages, a surface contact portion displaced from the disk attachment portion, an intermediate portion between the disk attachment portion and the surface contact portion, and a finishing blade element being angled away from the intermediate portion at selective angles, said finishing blade element having at least one edge portion thereon that is bent at an angle toward said disk to prevent scoring of the material being worked, the collar assembly comprising:

a tool spacer having an unthreaded tool shaft passage therethrough and a concentric annular spacer flange fitting closely within the tool attachment shaft passage of the disk when installed therewith; and an attachment nut having a threaded tool shaft installation passage therethrough and a concentric annular nut flange fitting closely within the tool attachment shaft passage of the disk when installed therewith;

the shaft flange and the nut flange having an additive total height less than the thickness of the disk, thereby clamping the disk securely between said tool spacer and said attachment nut when secured upon the rotary shaft of the power tool.

* * * * *